United States Patent [19]

Miller

[11] Patent Number: 4,589,346

[45] Date of Patent: May 20, 1986

[54] AXLE STOP ARRANGEMENT FOR SINGLE AXLE WHEEL TRUCK FOR A SKELETON TYPE RAILWAY CAR

[75] Inventor: Roy W. Miller, Highland, Ind.

[73] Assignee: Pullman Standard, Inc., Chicago, Ill.

[21] Appl. No.: 535,406

[22] Filed: Sep. 26, 1983

[51] Int. Cl.[4] ..... B61F 5/42

[52] U.S. Cl. ..... 105/171; 105/193; 105/199 S; 105/222; 105/224 R

[58] Field of Search ..... 105/224 R, 222, 218 R, 105/157 R, 171, 193, 199 S, 225, 453, 165; 267/40, 3

[56] References Cited

U.S. PATENT DOCUMENTS 4,433,629 2/1984 Roush, Jr. ..... 105/222
4,480,554 11/1984 Brodeur et al. ..... 105/171

FOREIGN PATENT DOCUMENTS 2030277 12/1971 Fed. Rep. of Germany ..... 105/312
0023615 of 1902 United Kingdom ..... 105/225

*Primary Examiner*—Randolph A. Reese
*Attorney, Agent, or Firm*—Richard J. Myers & Assoc.

[57] ABSTRACT

The wheel and axle assembly of a single axle wheel truck for a railway car is prevented from exceeding acceptable lateral and longitudinal movement with respect to fixed body portions of the railway car by an axle stop arrangement positioned laterally outboard of the wheel truck springs. This axle stop arrangement controls the wheel set movement relative to the car body and, due to its laterally outboard positioning, engagement between the axle stop structure and the wheels is prevented.

17 Claims, 6 Drawing Figures

AXLE STOP ARRANGEMENT FOR SINGLE AXLE WHEEL TRUCK FOR A SKELETON TYPE RAILWAY CAR

BACKGROUND OF THE INVENTION

1. Field of the Invention

This invention relates to structure for positively limiting the lateral and longitudinal movement of an axle housing of a single axle railway car wheel truck for a skeleton type railway car.

2. Description of the Prior Art

Axle stop structures for single axle wheel trucks for full bodied cargo carrying cars are old and well known and have long been in use, particularly in the British Isles. Such structures have commonly been placed between the suspension system and the wheels on each side of the wheel and axle assembly and the axle stop structure has consequently been positioned to interferingly engage the wheels under some operating condition of the car, such as short curvatures or trackage misalignment. This interference is undesirable as it causes wasteful component wear and increases the energy expended to move the car or keep it moving.

SUMMARY OF THE INVENTION

Two cantilevered axle stop members rigidly affixed to transverse bolsters attached to the center sill of a skeleton type railcar together with a support bracket which depends from a portion of the car body extending longitudinally between the bolsters are positioned laterally outward from the suspension system of the wheel track on each of two sides of the wheel track. The two members and the depending support bracket coact to effectively limit the lateral and longitudinal movement of the wheel and axle assembly with respect to fixed body portions of the car without interferingly engaging the wheels of the wheel truck.

DETAILED DESCRIPTION OF THE PREFERRED EMBODIMENT

Figure 1:
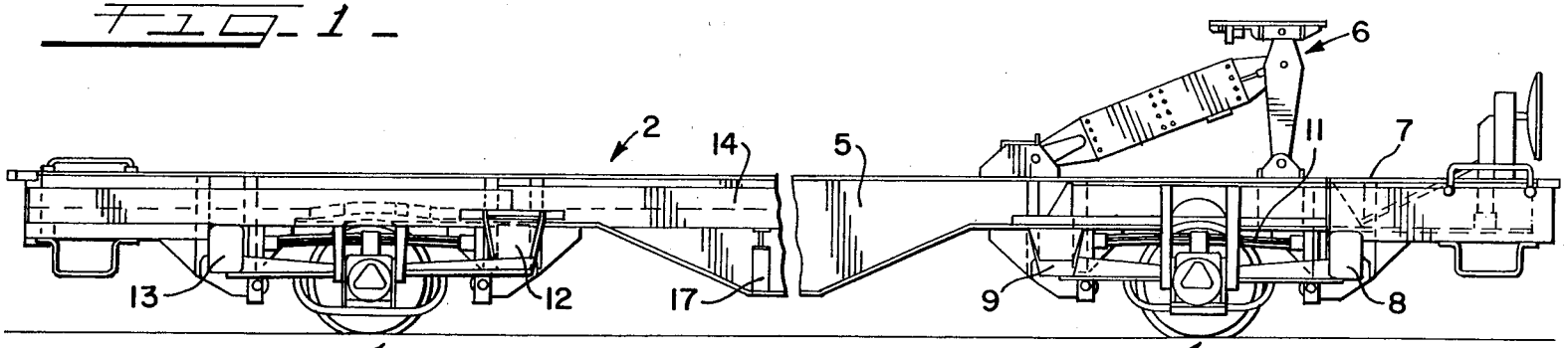
FIG. 1 is a side elevation view of a skeleton type railway car, from which a substantial portion of the center section has been cut away, showing two single axle wheel trucks having the axle stop structure of this invention.
Figure 2:
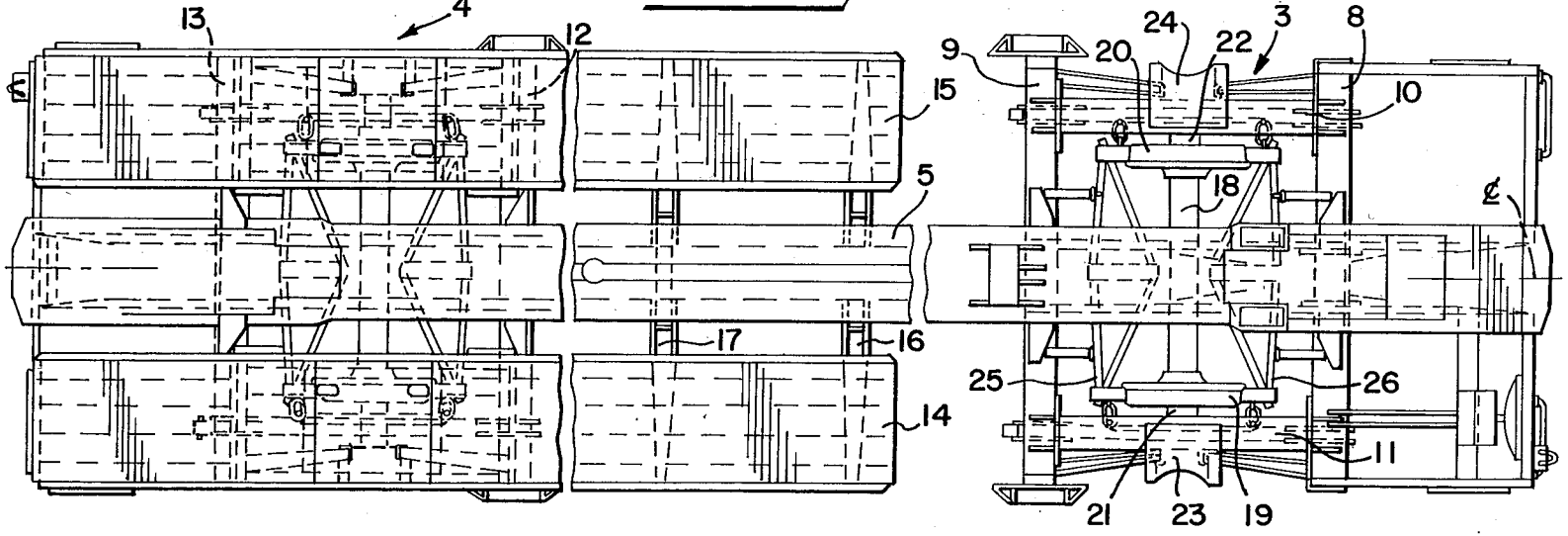
FIG. 2 is a plan view of the railway car shown in FIG. 1.

FIG. 1 is an elevation view and FIG. 2 in a plan view of a skeleton type railway car 2 having a first or front single axle wheel truck assembly 3 and a second or rear single axle wheel truck assembly 4. Car 2 has a central longitudinally extending draft and load bearing member, such as center sill 5. The car 2 is designed for hauling highway cargo trailers and therefore has a fifth wheel hitch assembly 6 mounted on the top surface 7 of center sill 5.

Front wheel truck assembly 3 is affixed to center sill 5 by a first transverse bolster 8 and a second transverse bolster 9. Bolsters 8 and 9 are rigidly affixed to center sill 5 by appropriate means, such as welding, and extend laterally outwardly from each side of center sill 5, as best shown in FIG. 2. A suspension means, such as spring systems 10 and 11, are positioned on each side of, and substantially parallel to, center sill 5. Systems 10 and 11 are laterally outwardly spaced from center sill 5 and engaged with a wheel housing of the wheel and axle assembly and to each of the bolsters 8 and 9.

Rear wheel truck assembly 4 is affixed to center sill 5 by a first transverse bolster 12 and a second transverse bolster 13. Bolsters 12 and 13 are rigidly affixed to center sill 5 by appropriate means, such as welding, and extend laterally outward from center sill 5.

A cargo trailer wheel support means, such as wheel support members 14 and 15, are laterally spaced from and positioned substantially parallel to center sill 5 and extend longitudinally along a substantial portion of center sill 5. Support members 14 and 15 are supported by bolsters 12 and 13 adjacent wheel truck assembly 4 and additionally are supported by a plurality of cross bearers, such as cross bearers 16 and 17. The rubber tired wheel assemblies of a highway cargo trailer (not shown) are positioned on and supported by support members 14 and 15 while the hitch assembly 6 lockingly engages the kingpin of the cargo trailer to maintain the cargo trailer on the skeleton railway car.

Railway cars such as shown in FIGS. 1 and 2 and described above are commonly referred to as skeleton cars, as they do not have a cargo bearing deck covering the car but rather have just the essential load bearing support members and hitch assembly affixed directly or indirectly to the backbone or center sill 5 of the car to haul the single load class, namely highway cargo trailers, for which they are designed.

As best shown in FIG. 2, front wheel truck assembly 3 is comprised of an axle 18 having a wheel 19 and a wheel 20 each mounted adjacent an end portion 21 and 22, respectively, of the axle. End portion 21 is rollingly engaged with an axle housing 23 and end portion 22 is rollingly engaged with an axle housing 24. A pair of brake beams 25 and 26 are mounted on each of two sides of axle 18.

Rear wheel truck assembly 4 has substantially the same structure as assembly 3. Each of the wheel trucks are substantially symetrical about center line CL of car 2, as shown in FIG. 2.

Figure 4:
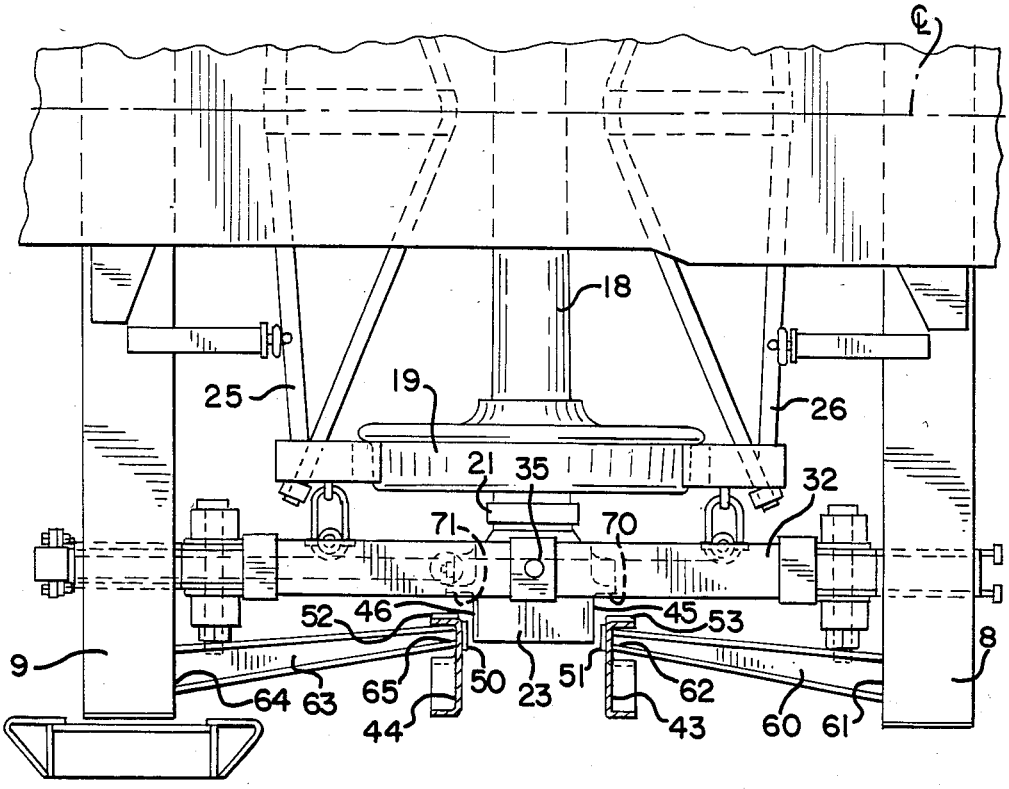
FIG. 4 is an enlarged plan view of the wheel truck shown in FIG. 3.
Figure 3:
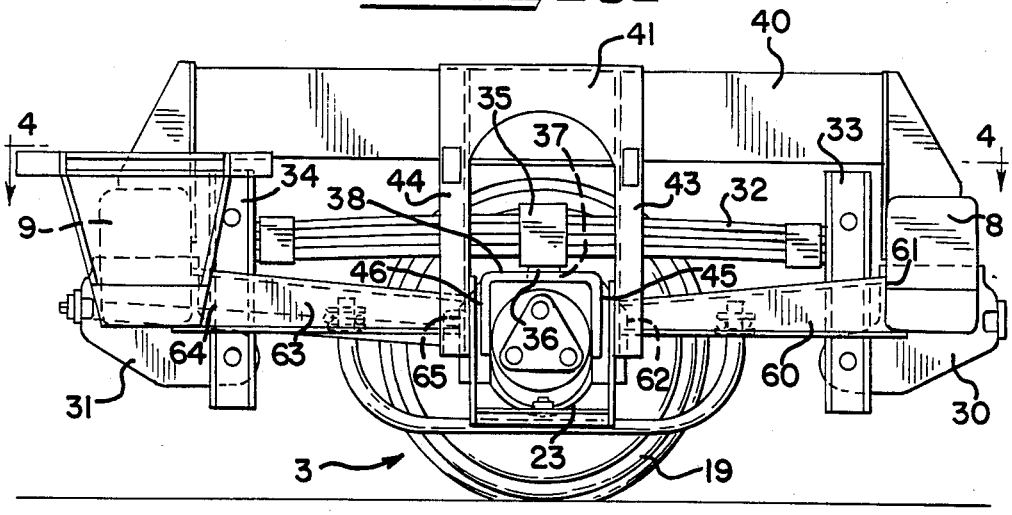
FIG. 3 is an enlarged elevation view of the front wheel truck shown in FIGS. 1 and 2.

FIG. 3 shows in enlarged detail an elevation view of wheel truck assembly 3 shown in FIGS. 1 and 2, and FIG. 4 shows in enlarged detail a partial sectional view of FIG. 3, as indicated by the section lines 4—4.

Referring to FIG. 3 and 4, wheel truck assembly 3 is comprised of a suspension system, such as spring systems 10 and 11 of FIG. 2, having a first spring link bracket 30 rigidly affixed to bolster 8 and a second spring link bracket 31 rigidly affixed to bolster 9. A suspension spring, such as leaf spring 32, extends longitudinally between the bolsters 8 and 9 and is connected to brackets 30 and 31 by engagement links 33 and 34, respectively.

At an intermediate portion a shackle 35 encompasses spring 32 and has a locating projection 36 engaged with a locating opening 37 in top surface 38 of axle housing 23. Therefore, as shown, the weight of the car body portion of car 2 is supported by the axle housing.

A support tube or member 40 extends between bolsters 8 and 9 and is rigidly affixed to each bolster. Rigidly affixed to and depending from tube 40 is an axle stop support bracket 41 which has depending axle and wheel assembly motion limiting means such as two longitudinally spaced braces or legs 43 and 44. Each leg is positioned on a longitudinal side 45 and 46 of axle housing 23 and is longitudinally spaced from side 45 or 46 of the axle housing when the housing is in a centered position as shown in FIGS. 3 and 4. As shown, each leg preferably has a longitudinally facing wear surface, such as wear plates 50 and 51, attached to it and each leg has a lateral inward facing wear surface, such as wear plates 52 and 53, attached to it. Each of the wear plates may be welded to the leg but are preferably removably rigidly attached to the leg by appropriate means, such as threaded fasteners, to facilitate replacement.

A first longitudinally extending axle stop strut 60 has a first end 61 rigidly affixed to bolster 8 and extends longitudinally toward axle housing 23 and has a second end 62 rigidly affixed to leg 43 of bracket 41.

A second longitudinally extending axle stop strut 63 has a first end 64 rigidly affixed to bolster 9 and extends longitudinally toward axle housing 23 and has a second end 65 rigidly affixed to leg 44 of bracket 41.

Leg 43 and strut 60 coact to provide a rigid longitudinal and lateral axle stop or motion limiter with respect to side 45 and a lateral limit flange 70 of axle housing 23 and leg 44 and strut 63 coact to provide a rigid longitudinal and lateral axle stop or motion limiter with respect to side 46 and a lateral limit flange 71 of axle housing 23. As previously stated above and as best shown in FIG. 2, wheel truck assembly 3 is substantially symetrical about center line CL of car 2 whereby the structure of the side adjacent wheel 20, not shown in FIG. 4, would be substantially a mirror image of the structure shown in FIG. 4 and described in detail above. As shown in FIG. 4, the axle stop surfaces 50, 51, 52 and 53 and the structure which maintains these surfaces in a spaced relationship to normally centered axle housing 23 are laterally outwardly spaced from suspension spring 32 to prevent any engagement or rubbing between the wheel 19 and the axle stop structure.

Also, longitudinally facing axle stop surfaces 50 and 51 are positioned to contact surfaces 46 and 45, respectively, as the wheel assembly is forced to move longitudinally with respect to the car body to limit longitudinal movement of the wheel assembly with respect to the car body supported by it.

Figure 5:
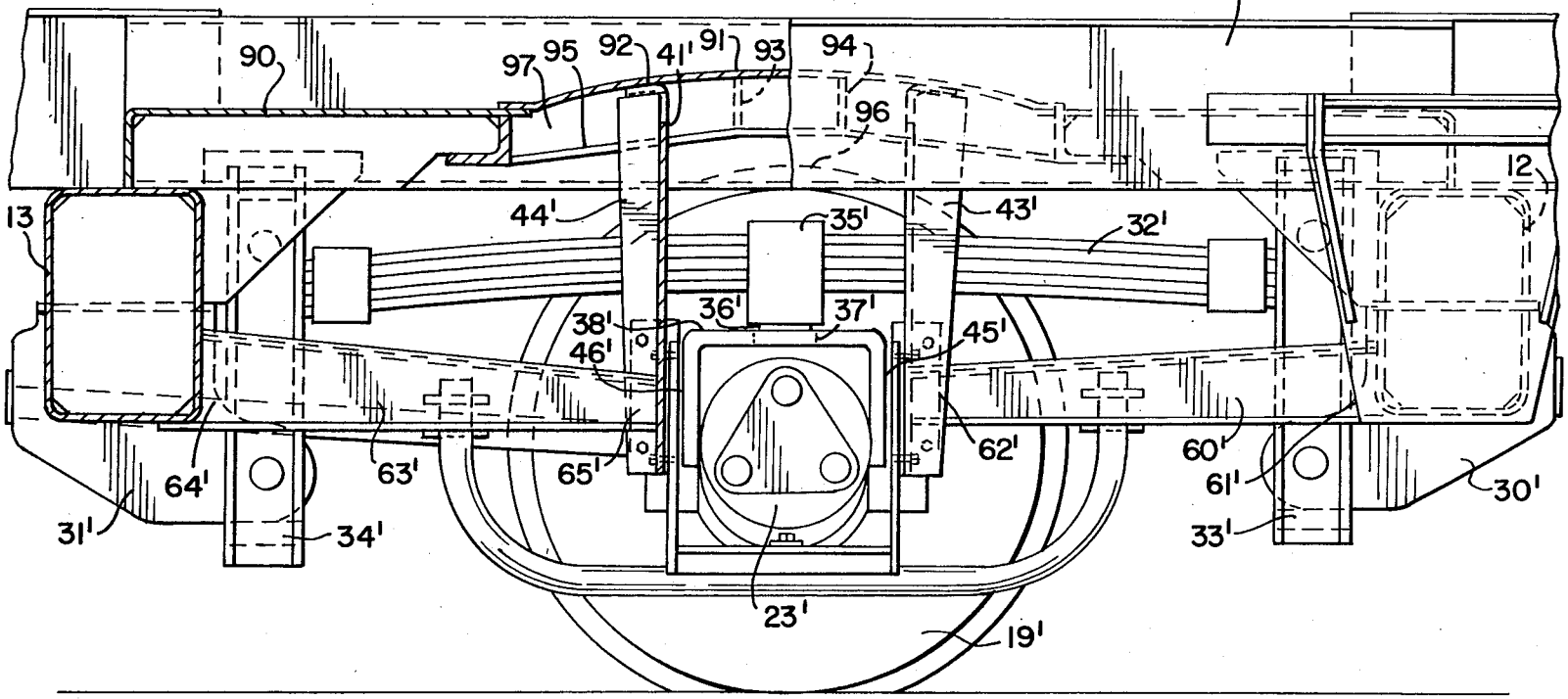
FIG. 5 is an enlarged elevation view of the rear wheel truck shown in FIGS. 1 and 2.
Figure 6:
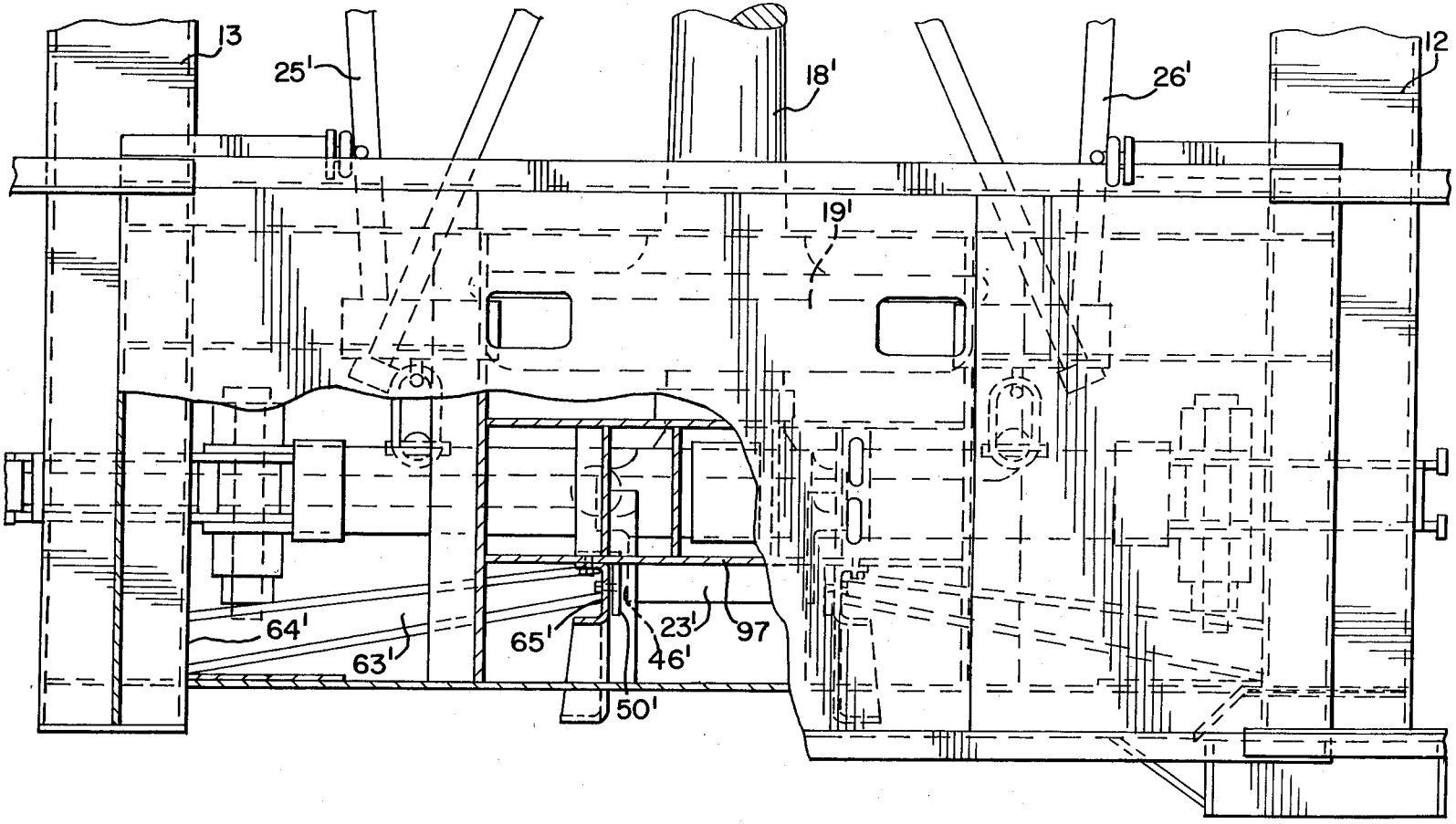
FIG. 6 is a plan view of the wheel truck shown in FIG. 5.

FIGS. 5 and 6 show an enlarged elevation view and enlarged partial plan view of rear wheel truck assembly 4 as shown in FIGS. 1 and 2.

With one important exception, described further below, all the structural elements and the functions of those elements are as described for wheel truck assembly 2 shown in FIGS. 3 and 4 and described in detail above. Therefore, the elements having similar structure and function on these FIGS. 5 and 6 have been identified with prime reference numerals and the description and functions as provided above for those corresponding elements in FIGS. 3 and 4 can be applied to FIGS. 5 and 6 also.

Due to the presence of the cargo trailer wheel supports or ramps 14 and 15 which are laterally spaced from center sill 5 and extend longitudinally along the car substantially parallel to the center sill 5 the axle stop support bracket 41' of truck assembly is affixed to a portion of wheel support 14 as shown in FIGS. 5 and 6.

Wheel support 14 is comprised of a substantially horizontally extending floor portion 90 which extends between, and beyond, bolsters 12 and 13. To provide clearance between floor portion 90 and the wheels, such as wheel 19', a bridging portion 91 of the floor is raised immediately above the wheels. Raised floor portion 91 has a top or upper load support member 92 and a plurality of transversely extending support members, such as members 93 and 94 and a lower or bottom member 95. As best shown in FIG. 5, portion 91 curves up over wheel 19' to prevent contact between a top portion 96 of wheel 19' and lower member 95 as the suspension spring 32' resiliently flexes.

As best shown in FIG. 6, bridging portion 91 has a longitudinally extending substantially vertically oriented support or plate member 97 rigidly affixed to it and the axle stop support bracket 41' is rigidly affixed to this support member 97. As with truck assembly 3, two legs 43' and 44' depend downwardly from bracket 41' and each leg is positioned on a longitudinal facing side of axle housing 23' and coact with axle stop struts 60' and 63' to limit lateral and longitudinal movement of the wheel, axle and axle housings of the wheel assembly of truck 4 in the same manner as described for wheel truck assembly 3 above.

Members 91, 93, 94 and 95 comprise a fabricated beam which extends laterally of the center sill 5. Bottom member 95 of this fabricated beam serves to limit downward vertical movement of the car body in the event spring 32' should break because member 95, and the rest of the adjacent portion of the car body, would fall or move downward to contact and rest on shackle member 35'.

Similarly, support tube 40 which extends between bolsters 8 and 9 serves to limit vertical downward movement of the front portion of the car body if a front spring 32 should break because the support tube would fall downwardly to contact and be supported by shackle member 35.

What is claimed is:

1. In a railway car having a longitudinally extending draft and load bearing member and two bolsters rigidly affixed to and extending transversely of said member, said bolsters being longitudinally spaced from each other along said member, a single axle wheel and axle assembly having two wheels and an axle, said wheel and axle assembly having a first axle housing rollingly engaged with a first end portion of said axle and a second axle housing rollingly engaged with a second end portion of said axle and resilient suspension means extending between said bolsters and being supportingly engaged by said housings for cushioned support of said draft and load bearing member, said bolsters and said suspension means rollingly supported by said wheel and axle assembly, said wheel and axle assembly being able to move laterally and longitudinally with respect to said bolsters and said draft and load bearing member due to the resilience of said suspension means, each of the axle housings having two longitudinally facing surfaces, the improvement comprising:

a first rigid bracket support means positioned above said first axle housing and a second rigid bracket support means positioned above said second axle housing, each of said bracket support means extending between and being rigidly affixed to each of said two bolsters;

a first axle stop bracket rigidly affixed to said first bracket support means, said bracket having means depending downwardly from said support means for being positioned in a spaced relationship from the two longitudinally facing surfaces of said first axle housing for limiting longitudinal movement of said axle housing with respect to said bolsters;

a second axle stop bracket rigidly affixed to said second bracket support means, said bracket having means depending downwardly from said support means for being positioned in a spaced relationship from the two longitudinally facing surfaces of said second axle housing for limiting longitudinal movement of said second axle housing with respect to said bolsters; and each of said means for limiting longitudinal movement of said axle housings being sufficiently laterally outward spaced from a wheel on said axle for preventing engagement between said movement limiting means and a wheel; and the axle housings being interposed between the means for limiting longitudinal movement and the wheels for preventing interengagement of the movement limiting means and the wheels.

2. The invention as defined in claim 1 in which each of said bracket support means is a rigid tube rigidly affixed to each of said two bolsters.

3. The invention as defined in claim 2 in which said suspension means is comprised of a leaf spring having a spring shackle supportingly engaged with a top surface of said axle housing, said spring shackle being in substantial vertical alignment with said rigid tube whereby said spring shackle serves to engage and limit downward movement of said rigid tube and said bolsters in the event of failure of said leaf spring.

4. The invention as defined in claim 1 in which each of said bracket support means is a portion of a cargo support member rigidly affixed to and extending between each of said two bolsters.

5. The invention as defined in claim 4 in which said suspension means is comprised of a leaf spring having a spring shackle supportingly engaged with a top surface of said axle housing, said spring shackle being in substantial vertical alignment with said bracket supporting portion of said cargo support member whereby said spring shackle serves to engage and limit downward movement of said bracket supporting portion of said cargo support member and said bolsters in the event of failure of said leaf spring.

6. The invention as defined in claim 1 together with a longitudinally extending flange on each axle housing and a laterally inboard facing surface on each of said movement limiting means for limiting lateral movement of said wheel and axle assembly with respect to said bolsters.

7. The invention as defined in claim 1 together with an axle stop support strut rigidly affixed to each of said movement limiting means and to a bolster.

8. In a railway car having a longitudinally extending draft and load bearing member and two bolsters rigidly affixed to and extending transversely of said member, said bolsters being longitudinally spaced from each other along said member, a single axle wheel and axle assembly having two wheels and an axle, said wheel and axle assembly having a first axle housing rollingly engaged with a first end portion of said axle and a second axle housing rollingly engaged with a second end portion of said axle and resilient suspension means extending between said bolsters and being supportingly engaged by said axle housings for cushioned support of said draft and load bearing member, said bolsters and said suspension means rollingly supported by said wheel and axle assembly, said wheel and axle assembly being able to move laterally and longitudinally with respect to said bolsters and said draft and load bearing member due to the resilience of said suspension means, each of the axle housings having two longitudinally facing surfaces, the improvement comprising:

a first rigid bracket support means positioned above said first axle housing and a second rigid bracket support means positioned above said second axle housing, each of said bracket support means extending between and being rigidly affixed to each of said two bolsters;

each of said means for limiting longitudinal movement of said axle housings being sufficiently laterally outward spaced from a wheel on said axle for preventing engagement between said movement limiting means and a wheel; and the suspension means being interposed between the means for limiting longitudinal movement and the wheels for preventing interengagement of the movement limiting means and the wheels.

9. A railway car comprising:

a car body having a longitudinally extending draft and load bearing member and two transversely extending bolster beams connected to the load-bearing member, said beams being spaced longitudinally from each other;

spring bracket means attached to the transversely extending bolster beams;

leaf spring means pivotally connected to the spring bracket means and extending between the transversely extending bolster beams;

a single axle wheel and axle assembly including an axle having two opposing end portions and a pair of axle housings, an axle housing being rollingly engaged with each of the end portions;

said leaf spring means having an intermediate portion engaging the axle housings to cushioningly support the weight of said car body received from said transversely extending bolster beams on said wheel and axle assembly;

a pair of stop support members attached to the transversely extending bolster beams and extending longitudinally therebetween, one of the stop support members being positioned generally above one of axle end portions and the other of the stop support members being positioned generally above the other of the axle end portions;

brace means connected to both of the stop support members and extending downwardly therefrom;

each of the axle housings having a pair of longitudinally facing surfaces;

the brace means having stop means in spaced relationship with respect to the longitudinally facing surfaces of the axle housings and engageable therewith to limit longitudinal movement of said axle housings with respect to said car body;

strut means connected to the transversely extending bolster beams and to the brace means for reinforcing said brace means when limiting longitudinal movement of said axle housings, and for transmitting loads applied to the brace means to the transversely extending bolster beams; and the axle housings being interposed between the brace means and the wheels to prevent engagement between said brace means and the wheels.

10. The invention according to claim 9 and the brace means comprising a pair of brace members extending downwardly from each support member, and the respective axle housing being positioned between said pair of brace members for limited longitudinal movement.

11. The invention according to claim 9, and the strut means of each axle stop bracket comprising a pair of strut members connected to the brace means, one of said strut members being connected to one of the transverse bolster beams and the other of the strut members being connected to the other of the transverse bolster beams.

12. The invention according to claim 9, and the support members comprising tube members attached to both of the transverse bolster beams.

13. The invention according to claim 9, and the stop support members each including a trailer wheel support member having arch portion over which the wheels of a trailer on the railway car may ride, said arch portion being curved to clear the wheels of the railway car.

14. The invention according to claim 9, and the strut means extending generally horizontally from the transverse bolster beams to support longitudinal loads received from the axle housings.

15. A railway car comprising:

a car body having a longitudinally extending draft and load bearing member and two transversely extending bolster beams connected to the load-bearing member, said beams being spaced longitudinally from each other;

spring bracket means attached to the transversely extending bolster beams;

leaf spring means pivotally connected to the spring bracket means and extending between the transversely extending bolster beams;

a single axle wheel and axle assembly including an axle having two opposing end portions and a pair of axle housings, an axle housing being rollingly engaged with each of the end portions;

said leaf spring means having an intermediate portion engaging the axle housings to cushioningly support the weight of said car body received from said transversely extending bolster beams on said wheel and axle assembly;

a pair of stop support members attached to the transversely extending bolster beams and extending longitudinally therebetween, one of the stop support members being positioned generally above one of axle end portions and the other of the stop support members being positioned generally above the other of the axle end portions;

brace means connected to both of the stop support members and extending downwardly therefrom;

each of the axle housings having a pair of longitudinally facing surfaces;

the brace means having stop means in spaced relationship with respect to the longitudinally facing surfaces of the axle housings and engageable therewith to limit longitudinal movement of said axle housings with respect to said car body;

strut means connected to the transversely extending bolster beams and to the brace means for reinforcing said brace means when limiting longitudinal movement of said axle housings, and for transmitting loads applied to the brace means to the transversely extending bolster beams;

the strut means of each axle stop bracket comprising a pair of strut members connected to the brace means, one of said strut members being connected to one of the transverse bolster beams and the other of the strut members being connected to the other of the transverse bolster beams; and each of the strut members being angulated to extend angularly inward on the railway car from the connection of the strut member to the respective transverse bolster beam to support loads received from the axle housings.

16. A railway car comprising:

a car body having a longitudinally extending draft and load bearing member and two transversely extending bolster beams connected to the load-bearing member, said beams being spaced longitudinally from each other;

spring bracket means attached to the transversely extending bolster beams;

leaf spring means pivotally connected to the spring bracket means and extending between the transversely extending bolster beams;

a single axle wheel and axle assembly including an axle having two opposing end portions and a pair of axle housings, an axle housing being rollingly engaged with each of the end portions;

said leaf spring means having an intermediate portion engaging the axle housings to cushioningly support the weight of said car body received from said transversely extending bolster beams on said wheel and axle assembly;

a pair of stop support members attached to the transversely extending bolster beams and extending longitudinally therebetween, one of the stop support members being positioned generally above one of axle end portions and the other of the stop support members being positioned generally above the other of the axle end portions;

brace means connected to both of the stop support members and extending downwardly therefrom;

each of the axle housings having a pair of longitudinally facing surfaces; the brace means having stop means in spaced relationship with respect to the longitudinally facing surfaces of the axle housings and engageable therewith to limit longitudinal movement of said axle housings with respect to said car body;

strut means connected to the transversely extending bolster beams and to the brace means for reinforcing said brace means when limiting longitudinal movement of said axle housings, and for transmitting loads applied to the brace means to the transversely extending bolster beams;

the strut means of each axle stop bracket comprising a pair of strut members connected to the brace means, one of said strut members being connected to one of the transverse bolster beams and the other of the strut members being connected to the other of the transverse bolster beams; and each of the strut members being tapered from the connection thereof to the respective transverse bolster beams.

17. A railway car comprising:

a car body having a longitudinally extending draft and load bearing member and two transversely extending bolster beams connected to the load-bearing member, said beams being spaced longitudinally from each other;

spring bracket means attached to the transversely extending bolster beams;

leaf spring means pivotally connected to the spring bracket means and extending between the transversely extending bolster beams;

a single axle wheel and axle assembly including an axle having two opposing end portions and a pair of axle housings, an axle housing being rollingly engaged with each of the end portions;

said leaf spring means having an intermediate portion engaging the axle housings to cushioningly support the weight of said car body received from said transversely extending bolster beams on said wheel and axle assembly;

a pair of stop support members attached to the transversely extending bolster beams and extending longitudinally therebetween, one of the stop support members being positioned generally above one of axle end portions and the other of the stop support members being positioned generally above the other of the axle end portions; brace means connected to both of the stop support members and extending downwardly therefrom;

each of the axle housings having a pair of longitudinally facing surfaces;

the brace means having stop means in spaced relationship with respect to the longitudinally facing surfaces of the axle housings and engageable therewith to limit longitudinal movement of said axle housings with respect to said car body;

strut means connected to the transversely extending bolster beams and to the brace means for reinforcing said brace means when limiting longitudinal movement of said axle housings, and for transmitting loads applied to the brace means to the transversely extending bolster beams; and the leaf spring suspension means engaging the axle housing outward of the wheels of the car and inward of the brace means for preventing engagement of the wheels therewith.

* * * * *